US005791247A

United States Patent [19]

Kolb

[11] Patent Number: 5,791,247

[45] Date of Patent: Aug. 11, 1998

[54] AIR SYSTEM FOR CONTROLLING THE DISCHARGE OF PRINTED MATERIAL FROM A PRINTING PRESS AND INK DEMULSIFIER

[76] Inventor: Daniel L. Kolb, 3401 152nd La., North West, Anoka, Minn. 55304-3004

[21] Appl. No.: 766,506

[22] Filed: Dec. 13, 1996

Related U.S. Application Data

[60] Provisional application No. 60/008,785 Dec. 18, 1995.

[51] Int. Cl.[6] ..... B41F 13/24

[52] U.S. Cl. ..... 101/232; 101/147; 101/219; 101/416.1; 101/424.1; 101/483; 101/228

[58] Field of Search ..... 101/216, 147, 101/424.1, 232, 181, 228, 227, 219, 233, 240, 416.1, 483, 484, 487, 488; 226/95, 96, 7

[56] References Cited

U.S. PATENT DOCUMENTS

| | | | |
|---|---|---|---|
| 2,204,802 | 6/1940 | Gessler | 101/424.1 |
| 5,255,602 | 10/1993 | Mamberger et al. | 101/228 |
| 5,553,542 | 9/1996 | Jackson et al. | 101/288 |
| 5,588,360 | 12/1996 | Kurz | 101/424.1 |

*Primary Examiner*—Christopher A. Bennett
*Attorney, Agent, or Firm*—Burd, Bartz & Gutenkauf

[57] ABSTRACT

A printing press having an ink carrying roller and a roller having a blanket is equipped with a printed sheet material stripper having air dispenser for directing streams of air toward the roller having the blanket to assist in separating the sheet material from the blanket. A second air dispenser directs streams of air toward the ink carrying roller to set up and dry water in the ink on the ink carrying roller. Air flow regulators control the pressure of the air supplied to the air dispensers.

25 Claims, 5 Drawing Sheets

AIR SYSTEM FOR CONTROLLING THE DISCHARGE OF PRINTED MATERIAL FROM A PRINTING PRESS AND INK DEMULSIFIER

CROSS REFERENCE TO RELATED APPLICATION

This application is a continuation of U.S. Provisional Application Ser. No. 60/008,785 filed Dec. 18, 1995.

FIELD OF THE INVENTION

The invention is in the field of accessories for a printing press operable to improve the efficiency of the press by controlling the egress of printed materials with flowing air and to provide an ink dehumidifier to allow the use of low alcohol and water-based inks.

BACKGROUND OF THE INVENTION

Printing presses have rotating drums or rollers supporting blankets containing the image to be printed on sheet material, such as envelopes. The inks used in these presses contain a considerable amount of alcohol. The inks are dispensed on rollers used to transfer the inks to blankets mounted on another roller. Low alcohol inks and water-based inks can cause wash-out and dull colors when used with conventional printing presses. The printing industry is moving toward more environmentally safe, alcohol-free inks. This leaves the printer with only a small window for ink and water adjustments.

The printed materials egress from the presses onto conveyors that transport them to a remote location for packaging, storage and shipping. The printed materials must be released from the presses onto conveyors that transport them to a remote location for packaging, storage and shipping. All of the printed materials must be released from the blankets for continued operation of the presses. When the printed materials adhere to the blankets, the blankets are destroyed and cause press jam-ups. The press must be shut down, cleaned and provided with new blankets. This is costly down time. Some of the printed materials have curled and twisted shapes so they do not lie flat on the conveyor. This makes it difficult to handle the printed product. The air stripper and ink demulsifier of the invention mitigate these objections to conventional printing presses.

SUMMARY OF THE INVENTION

The invention is embodied in accessories to printing presses which allow the press to run alcohol-free water inks and aids in separating printed materials, such as envelopes, off the blankets. The accessories are herein identified as an air stripper apparatus and an ink demulsifier. The ink demulsifier can be used independently of the air stripper apparatus or in combination with the air stripper apparatus. The air stripper apparatus aids in separating or peeling the printed material from the blankets thereby reducing smashed blankets, jam-ups of the press and down time. Heavy ink coverage on the printed material causes sticking of the printed material to the blankets. This condition is avoided by the operation of the air stripper apparatus. The printed material is removed from the blankets with strippers having noses located closely adjacent the roller carrying the blankets. Stripper nozzles mounted on the strippers direct streams of air toward the blankets over the top of the printed materials. The streams of air peel the printed materials off of the blankets so that the strippers pick up the printed materials and direct the printed materials toward a conveyor and blow the printed materials flat onto the conveyor. An air dispenser located above the conveyor discharges air in a direction toward the printed materials to direct the printed materials toward the conveyor. An air controller having an adjustable air pressure regulator and a valve controls the pressure and flow of air to the stripper nozzles.

The ink demulsifier has an air dispenser operable to direct air toward the rollers transferring ink to the blankets. An air regulator and air flow control valve controls the air pressure and flow of air to the dispenser which directs the air toward the roller to aid the drying of the water in the ink on the rollers.

One embodiment of the stripper air dispenser comprises an elongated tube having a closed end. The opposite end of the tube is connected to the hose that leads to the air controller. Brackets secured to the frame of the printing press contain circular sleeves that encompass opposite ends of the tube. One sleeve has a set screw that is turned down onto the tube to hold the tube in a fixed position. The opposite end of the tube is located in a split or C-shaped member that is fastened with a bolt to allow angular adjustment of the dispenser. The brackets are connected to the frame of the printing press with a pair of bolts. Each bolt is threaded into the threaded bore for the grease fitting of the printing press. The bolt is provided with an elongated passage. The head of the bolt has a passage that accommodates the grease fitting. Grease can then be pumped through the grease fitting, the bolt and into the bearing structure of the printing press. The purpose of this arrangement eliminates the need for additional holes or added structures to the printing press to accommodate the stripper air dispenser. The air dispenser has a plurality of nozzles that direct streams of air toward the tops of the printed materials moving from the printing press. The nozzles have circular air outlet orifices. The flow of air through each nozzle is controlled with a needle valve. The needle valve comprises a cylindrical member or bolt threaded into the tube opposite each nozzle. A spring is located between the tube and the head of the needle valve bolt and holds the bolt in its adjusted position. A wrench can be used to adjust each needle valve. This enables the printer to individually adjust the flow of air through each of the nozzles.

The strippers are equipped with stripper nozzles connected with hoses to the tubes which carry air to these nozzles. The stripper nozzles, mounted on the side of the strippers, direct streams of air adjacent the inclined forward surface of the stripper to facilitate the removal of printed material from the blankets and movement of the printed material downward to an arm of the stripper. The printed materials move toward the conveyor. The stripper has a housing having a generally U-shaped pocket. A set screw on one leg of the pocket is used to adjustable attach the stripper to a transverse bar on the printing press. This allows for lateral movement of the stripper to accommodate different sizes of printed materials. The opposite end of each hose is connected to a valve having a rotatable member for adjusting the flow of air to the stripper nozzle. The valve is mounted on the tube and supplied with air under pressure from the tube.

The air controller has a generally rectangular box surrounding an inside chamber that accommodates a solenoid-operated valve that has a connector coupled to a pipe that delivers air under pressure to the solenoid-operated valve. A plurality of electrical lines connected to the solenoid lead to the controls of the printing press so that when the printing press is turned on, the solenoid valve is operated to allow air under pressure to flow through the solenoid valve and to a T coupling via a short hose. The T coupling is connected to two pressure regulator valves. One pressure regulator valve has an outlet nipple that is connected to the hose leading to the tube. The valve has an actuator that is movable in an up position to rotate the valve. When the actuator is moved to the down position, it is locked. The valve is a Speed-Aire Flow Control Valve Model No. 6ZC33A having a maximum psi of 250 psi. The maximum inlet pressure is 250 psi at 125 degrees F. The valve has a housing having an upwardly-directed threaded portion and a nut on the threaded portion that holds the valve on the housing. The actuator is located above the top of the housing.

The second flow control valve connected to the T coupling is also mounted on the top of the housing. This valve has an upwardly-directed threaded portion that accommodates a nut used to clamp the second valve to the top wall of the housing. The second flow control valve has an outlet nipple that accommodates a hose leading to a pair of air flow control valves mounted on the top of the housing. Each air flow control valve has an outlet nipple that accommodates a separate elongated flexible hose and a threaded member that can be turned to adjust the rate of flow through the valve.

Hoses connected to the air flow control valves are joined to elongated hollow bars having a plurality of small holes. Each bar has holes equally spaced along its length. The side of the bar 90 degrees from the holes has an elongated, flexible insulating strip of resilient plastic material. The plastic material is located within a generally U-shaped groove in the side of the bar and attached thereto with an adhesive.

Each bar has circular journals or portions that accommodate bands which hold the bar on cross members of the printing press. The bars are air emulsifiers in that they discharge streams of air toward the ink on the rollers. Emulsifiers are used with low alcohol content inks and water-based inks to facilitate the setting and drying of the inks.

DESCRIPTION OF THE PREFERRED EMBODIMENT

Figure 1:
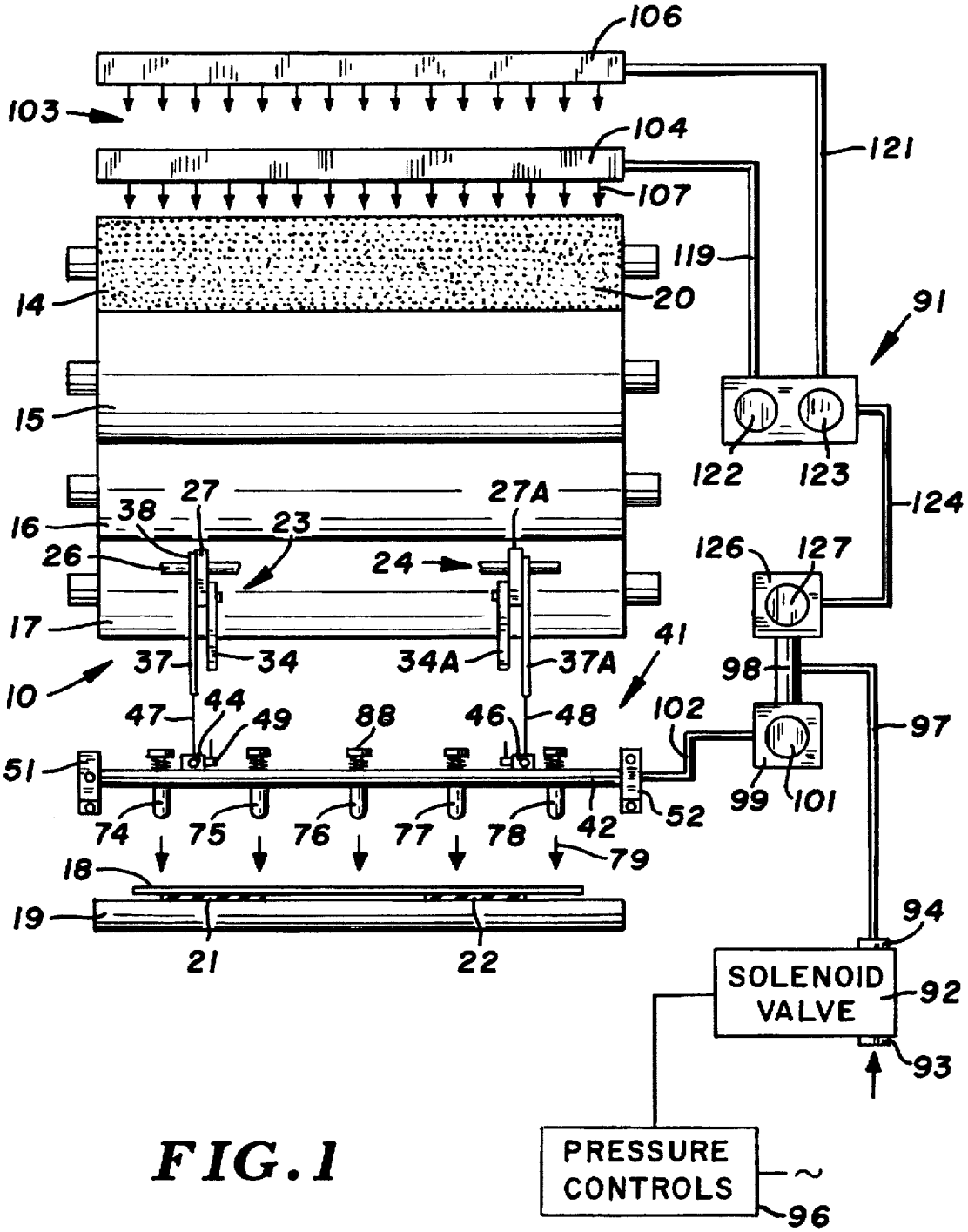
FIG. 1 is a diagrammatic view of the air stripper apparatus of the invention having air dispensers for controlling the discharge of printed material from a printing press and an ink demulsifier for low alcohol and water-based inks.

The air stripper apparatus, indicated generally at 10 in FIG. 1, is used with a printing press 11 for controlling the discharge of printed materials from the press. An example of a suitable press is the Halm Jet Press. Other types of printing presses can accommodate air stripper apparatus 10. Air stripper apparatus 10 reduces costly down time of the press as it peels the printed material off blankets 25 of the press. This reduces breakage of blankets 25 and provides the ability to run the press with full blankets 25. Hard-to-run printed materials, such as curly envelopes and full ink coverage jobs, are efficiently completed with the use of air stripper apparatus 10 with the printing press. Air stripper apparatus 10 provides the printing press with the ability to run four up on the back side of envelopes without them tucking under the envelope flaps.

Figure 2:
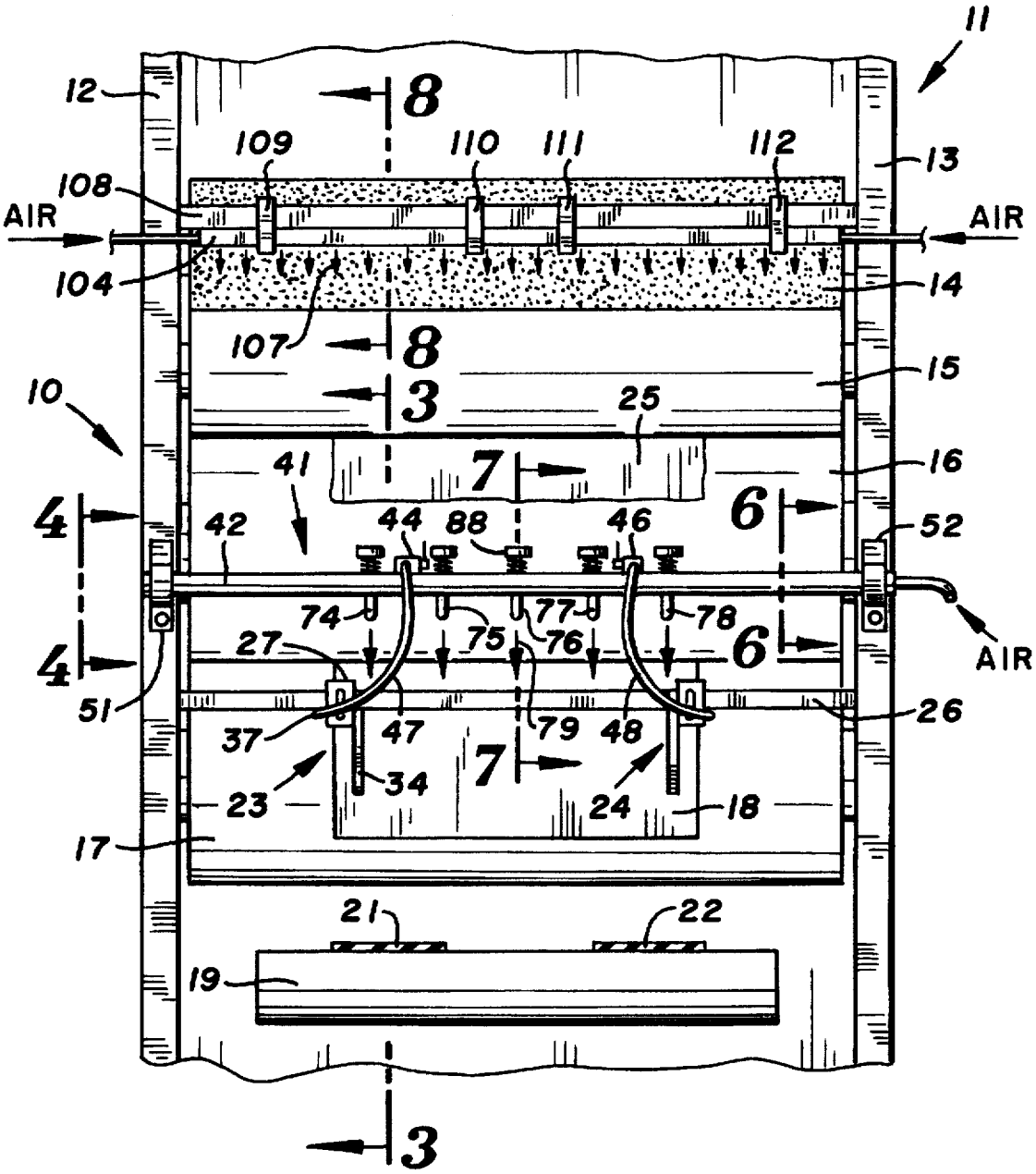
FIG. 2 is an exit end elevational view of a printing press equipped with the apparatus of FIG. 1.

As shown in FIG. 2, printing press 11 has side frame members 12 and 13 rotatably supporting drums or rollers 14, 15, 16 and 17. The blankets 25 of the press are mounted on roller 16. The rollers 14–17 are power-driven to move sheet members 18, such as envelopes, through the press and discharge sheet members 18, known as printed materials, onto a conveyor 19. Conveyor 19 is a conventional unit having moving endless belts 21 and 22 for carrying the printed materials to a desires location for packaging, storing and shipping operations.

Figure 3:
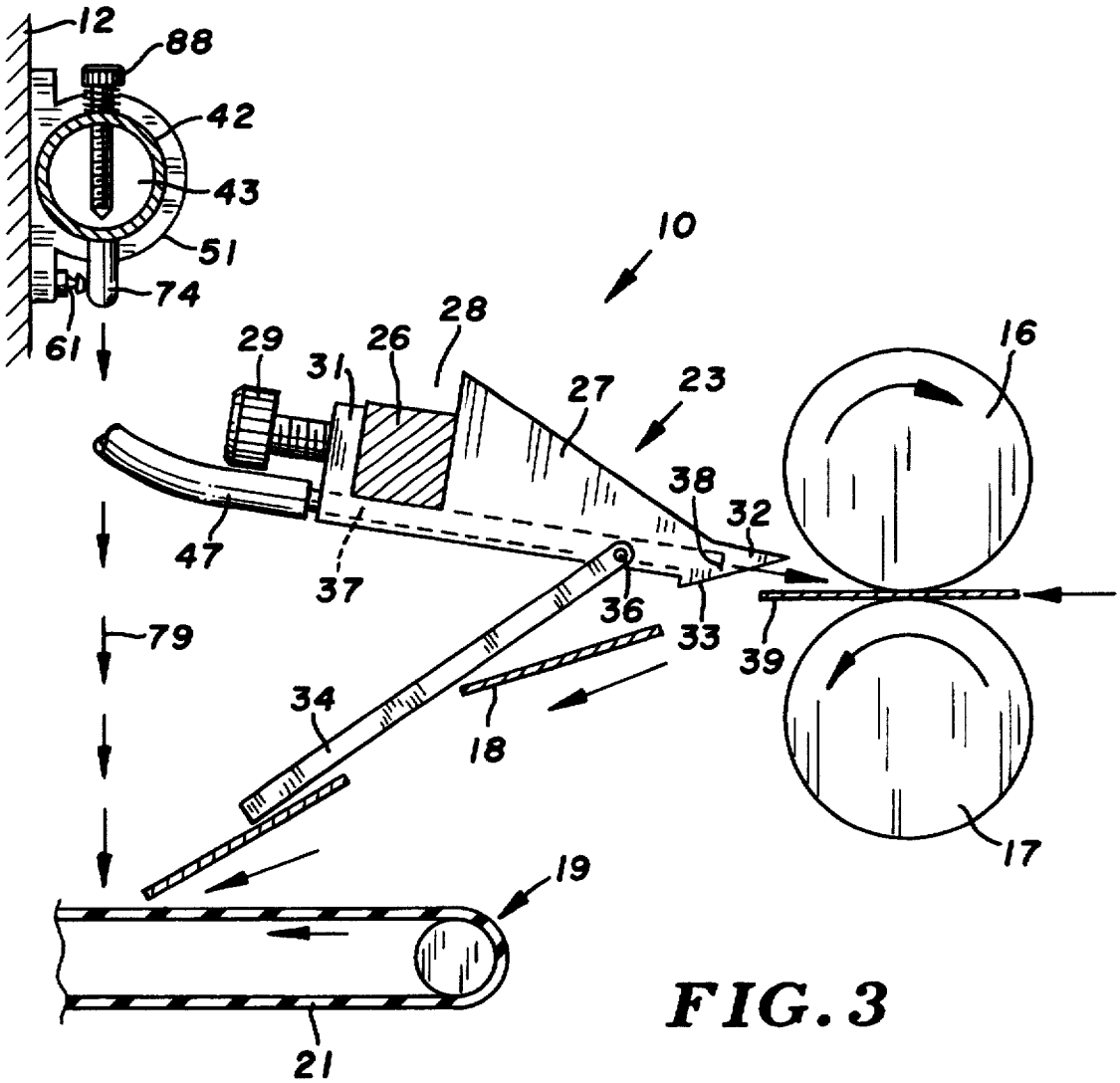
FIG. 3 is an enlarged sectional view taken along the line 3—3 of FIG. 2.

As shown in FIGS. 1 and 2, apparatus 10 has a pair of strippers 23 and 24 mounted on a crossbar 26 extended between and secured to frame members 12 and 13. Strippers 23 and 24 are laterally-spaced on bar 26 to aid in the removal of printed material 18 from the blanket as it emerges from roller 16 and direct printed material 18 toward conveyor 19. The structures and functions of stripper 23 and 24 are identical. The parts of stripper 24 that are the same as stripper 23 have the same reference numbers with a suffix A. FIG. 3 shows the details of stripper 23. Stripper 23 has a generally triangular-shaped body 27 with a transverse groove 28 accommodating crossbar 26. A set screw 29, threaded into a leg 31, clamps body 27 on crossbar 26. Set screw 29 allows body 27 to be selectively positioned along the length of crossbar 26 to accommodate different sizes of printed materials. The forward end of body 27 has a pointed nose 32 and a downwardly and rearwardly-inclined surface 33. Nose 32 is located close to the surfaces of the blankets on roller 16. Printed material 18, as it leaves press rollers 16 and 17, engages surface 33 of nose 32 and moves down toward conveyor 19. A long arm 34 connected with bolt 36 to body 27 behind surface 33 projects downwardly and rearwardly toward conveyor 19 to ensure that printed material 18 moves onto conveyor 19.

An elongated tubular member or nozzle 37 secured to body 27 with a channel member 40 has an air discharge end 38 located adjacent the point of nose 32 to deliver a stream of air, shown by arrow 39 in FIG. 3, adjacent the top surface of printed material 18 as it leaves rollers 16 and 17. The stream of air 39 peels the printed material off the blanket on roller 16, thereby eliminating sticking of the printed material to the blanket.

Returning to FIGS. 1 and 2, air under pressure is obtained from a manifold 41 comprising an elongated tube 42 having an internal passage 43 accommodating air. Valves 44 and 46, mounted on tube 42, are joined to hoses 47 and 48 connected to stripper nozzles 37 and 37A. Each valve 44 and 46 has a movable member 49, such as a cylinder with a hole, to adjust the rate of flow of air to tube 37 thereby adjusting the velocity of the air stream flowing from end 38 toward roller 16. Adjustable needle valves can be used to connect hoses 47 and 48 to tube 42 and provide for air flow regulation.

Figure 4:
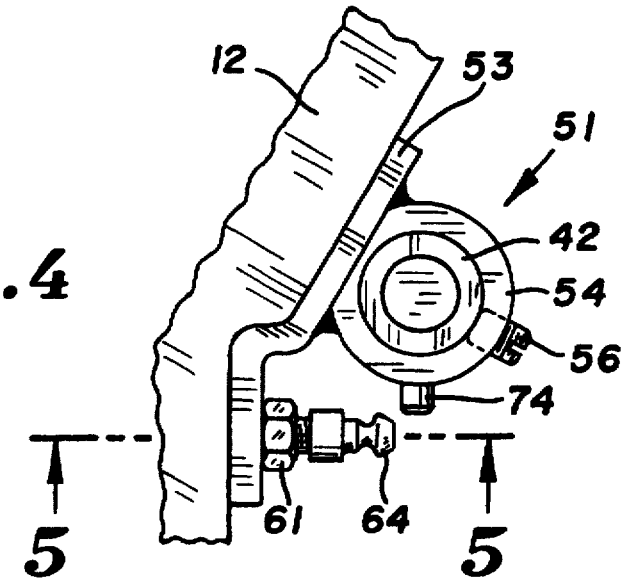
FIG. 4 is an end view taken along the line 4—4 of FIG. 2.

Opposite ends of tube 42 are attached to frame members 12 and 13 with mounts 51 and 52. As shown in FIG. 4, mount 51 has an off-set bracket 53 to fit the shape of frame member 12. A sleeve 54, secured by welds to bracket 53, surrounds tube 42. A set screw 56, threaded into sleeve 54, retains tube 42 in a selected position on sleeve 54.

As shown in FIG. 51 a bolt 57, threaded into a bore 58 in frame member 12, passes through a hole 59 in bracket 53. A nut 61, threaded on bolt 57, clamps bracket 53 to frame member 12. Bolt 57 has a head 62 with a bore 63 and a longitudinal passage 66 open to bore 63. A grease fitting 64 is pressed into bore 63 so that grease can be supplied to the bearings of roller 16. Bolt 57 replaces the original grease fitting on frame member 12 so that a new hole need not be drilled and threaded in frame member 12.

Figure 5:
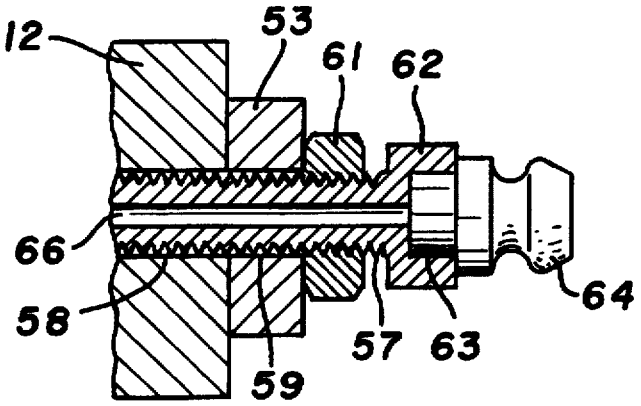
FIG. 5 is an enlarged sectional view taken along the line 5—5 of FIG. 4.
Figure 6:
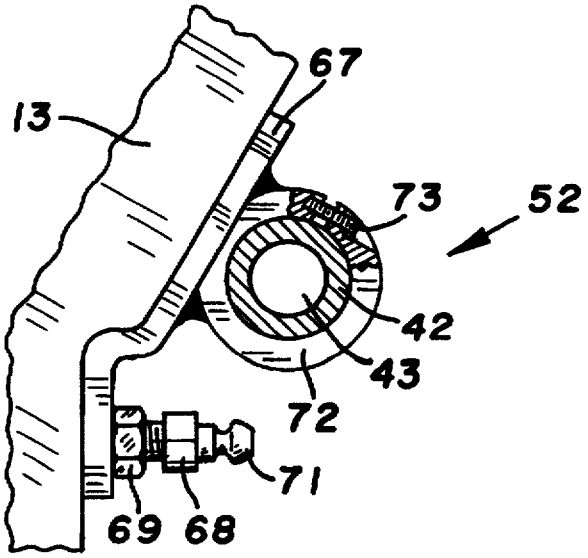
FIG. 6 is an enlarged sectional view taken along the line 6—6 of FIG. 2.

Mount 52, as shown in FIG. 6, has an off-set bracket 67 that fits frame member 13. A bolt 68 and nut 69 retain bracket 67 on frame member 13. A grease fitting 71 is mounted on bolt 68. Bolt 68, nut 69 and grease fitting 71 is the same structure as shown in FIG. 5. A split sleeve 72 welded on bracket 67 surrounds tube 42. A bolt 73 spans the slit in sleeve 72 to clamp sleeve 72 to tube 42. Bolt 73 can be released to allow angular adjustment of tube 42 to change the direction of the air streams flowing from nozzles 74, 75, 76, 77 and 78 secured to tube 42. The air streams, shown as arrows 79, are directed downward to force printed materials 18 onto conveyor belts 21 and 22.

Figure 7:
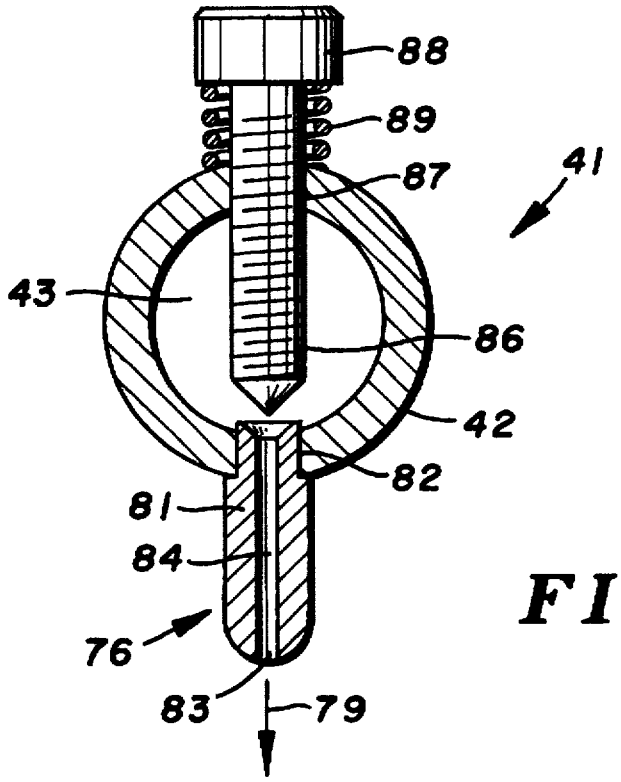
FIG. 7 is an enlarged sectional view taken along the line 7—7 of FIG. 2.

Nozzles 74–78 are laterally spaced along the length of tube 42. The number and spacing of nozzles 74–78 can vary along the length of tube 42. As shown in FIG. 7, nozzle 76 has a tubular member 81 threaded into a hole 82 in tube 42. The outer end of tubular member 81 has a small orifice 83. Orifice 83 is open to a passage 84 in tubular member 81 leading to the large passage of tube 42, which supplies air under pressure to all nozzles 74–78. The flow of air through passage 84 is controlled with an adjustable needle 86 threaded into a hole 87 opposite nozzle 76. Needle 86 has a head 88 with accommodations for a tool used to turn needle 86 selectively toward and away from the entrance of nozzle passage 84 thereby adjusting the flow of air through nozzle 76. A coil spring 89 interposed between head 88 and tube 42 retains needle 86 in its adjusted position. Each of nozzles 74, 75, 77 and 78 have separate associated needles, as shown in FIG. 7, to control the flow of air through the nozzles.

An air controller, indicated generally at 91 in FIG. 1, regulates the flow and pressure of air directed into tube 42 and an ink demulsifier hereinafter described. Controller 91 has a solenoid valve 92 with an air inlet 93 coupled to supply air under pressure and an air outlet 94. The electrical system of press controls 96 energizes solenoid valve 92 when the press is turned ON so that the air flows through solenoid valve 92 into a line 97 connected to a T coupling 98. Coupling 98 is attached to a first air pressure regulator 99 having an adjustable control 101 for regulating the air flow and air pressure out of regulator 99 into a hose 102 leading to the end of tube 42. Regulator 99 ensures a continuous supply of air to tube passage 43 at a selected and substantially constant pressure.

Figure 8:
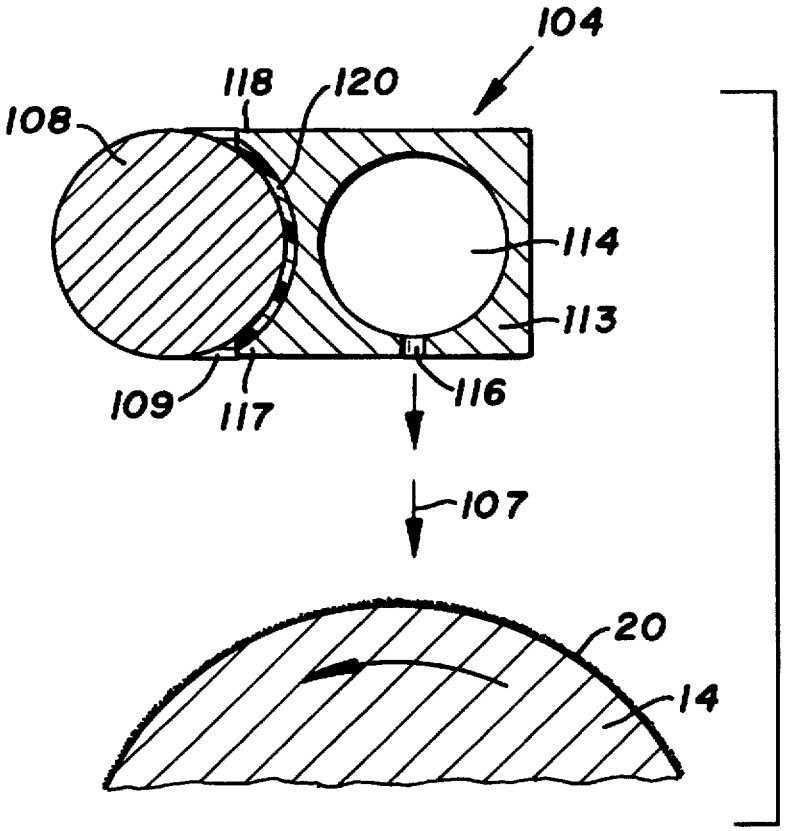
FIG. 8 is an enlarged sectional view taken along the line 8—8 of FIG. 2.

Printing press 11 is equipped with an ink demulsifier, indicated generally at 103, used by printers to run alcohol-free without problems of toning and emulsifying. Water-based inks can be used with a printing press having ink demulsifier 103. Ink demulsifier 103 has a pair of air dispensers 104 and 106. Dispenser 104 is operable to direct a plurality of streams of air, shown as arrows 107 in FIGS. 1 and 2, toward roller 14 carrying water-based inks or low alcohol inks to set up and dry the water in the inks. Separate air dispensers are used for the different color inks on separate rollers of the press. Dispenser 106 directs streams of air toward a second roller carrying a different color of ink. As shown in FIG. 2, dispenser 104 is mounted on a crossbar 108 extended between and attached to frame members 12 and 13 adjacent drum 14. Fasteners 109, 110, 111 and 112, such as loops or ties, secure air dispenser 104 to crossbar 108. As shown in FIG. 8, dispenser 104 is an elongated bar 113 having an internal longitudinal passage 114. The bottom of bar 113 has a plurality of small orifices 116 open to passage 114 to allow air to flow from passage 114 to the atmosphere as shown by arrow 107 toward roller 14 carrying ink 20. Orifices 116 are laterally-spaced from each other along the length of bar 113. Bar 113 has a pair of flanges 117 and 118 accommodating a strip of plastic material engageable with crossbar 108 to prevent the rocking of dispenser 104 on crossbar 108. Flanges 117 and 18 can be on the side or top of bar 113. Fasteners 109 and 110 retain the lower part of crossbar 108 in the space between flanges 117 and 118. Air dispenser 106 has the same structure as air dispenser 104.

Air dispensers 104 and 106 are connected to air lines 119 and 121 leading a pair of adjustable valves 122 and 123 on air controller 91. Valves 122 and 123 are needle valves used to adjust the flow of air to air dispensers 104 and 106. An air line 124 couples valves 122 and 123 to a second air pressure regulator 126 connected to T-coupling 98. Regulator 126 has an adjustable control 127 for regulating the air flow and air pressure delivered to air line 124.

In use, a conventional printing press can be equipped with either air stripper apparatus 10, ink demulsifier 103, or the combination of air stripper apparatus 10 and ink demulsifier 103. Tube 42 is mounted on sleeves 54 and 72 which are secured to press frame members 12 and 13 with brackets 53 and 67, as shown in FIGS. 2, 4 and 6. The angle of nozzles 74–78 is adjusted by rotating tube 42 and securing tube 42 in an adjusted position to change the air impact locations of the air streams on the printed materials.

Strippers 23 and 24 are mounted on crossbar 26 and laterally adjusted according to the size of the printed material. Stripper nozzles 37 and 37A direct streams of air toward roller 16 to peel printed material from the blankets. The rate of flow of air discharged by nozzles 37 and 37A is regulated with valves 44 and 46, and air pressure regulator 99. The printed material 18 slides down arms 34 and 34A toward conveyor 19. Air streams 78, from nozzles 74–78, direct the printed materials onto conveyor 19.

Ink demulsifier 103 is mounted on crossbar 108 with fasteners 109–112. The angles of bars 104 and 106 are adjusted so that the air dispensed through holes 116 is directed toward inked rollers associated with the bars. The air helps to dry the water in the ink on the rollers. This helps prevent wash-out appearance of the print and keeps printing colors bright and sharp. Water-based inks and low-alcohol inks can be effectively utilized in the printing operation with the use of ink demulsifier 103.

There has been shown and described one embodiment of the air stripper apparatus and ink demulsifier of the invention. Changes in the structures and arrangement of parts can be made by one skilled in the art without departing from the invention. The invention is defined in the following claims.

I claim:

1. An apparatus for stripping printed sheet material from a printing press having a frame, rollers and a blanket on one of the roller operable to print the sheet material comprising:

stripper means mountable on the frame adjacent the roller having the blanket for assisting the separation of printed sheet material from the blanket, said stripper means including means for directing a stream of air toward the roller having the blanket whereby the stream of air assists the separating printed sheet material form the, a body, means for mounting the body on the frame, said body having a nose projected toward the roller having a blanket, and means for mounting the means for directing a stream of air toward the roller having the blanket on the body.

2. The apparatus of claim 1 including:

arm means mounted on the body for directing printed sheet material moving past the nose away from the body.

3. The apparatus of claim 1 wherein:

the means for directing a stream of air toward the roller having the blanket includes a tube having an open end located adjacent the roller having the blanket for directing a stream of air toward the roller having the blanket whereby the stream of air assists in separating printed sheet material from the blanket.

4. The apparatus of claim 1 wherein:

said body having a nose projected toward the roller having a blanket, said means for directing a stream of air toward the roller having the blanket comprising a tubular member having an open end adjacent the nose facing the roller having the blanket to direct the stream of air toward the blanket to assist in separating the sheet material from the blanket.

5. The apparatus of claim 4 including:

arm means mounted on the body for directing printed sheet material moving past the nose away from the body.

6. The apparatus of claim 1 wherein:

the stripper means has two means for directing two separate streams of air toward the roller having the blanket whereby the two streams of air assists in separating printed sheet material from the blanket.

7. The apparatus of claim 6 wherein:

each means for directing air has tube means with an open end located adjacent the roller having the blanket for directing a stream of air toward the roller having the blanket to assist in separating printed sheet material from the blanket.

8. An apparatus for stripping printed sheet material from a printing press having a frame, rollers and a blanket on one of the rollers operable to print the sheet material comprising:

stripper means mountable on the frame adjacent the roller having the blanket for assisting the separation of printed sheet material from the blanket, the stripper means comprises a first stripper and a second stripper spaced from the first stripper, means for mounting the first stripper and second stripper on the frame adjacent the roller having the blanket for assisting the separating of printed sheet material from the blanket, each stripper having means for directing a stream of air toward the roller having the blanket whereby the streams of air assists in separating printed sheet material from the blanket.

9. The apparatus of claim 8 wherein:

the means for directing a stream of air toward the roller having the blanket has tube means with an open and located adjacent the roller having a blanket for directing a stream of air toward the roller having the blanket to assist in separating printed sheet material from the blanket.

10. The apparats of claim 9 wherein:

each stripper has a body, means for mounting the body on the frame, said body having a nose projected toward the roller having the blanket, means mounting the tube means on the body, and arm means mounted on the body for directing printed sheet material moving past the nose away from the body.

11. The apparatus of claim 1 including:

air dispenser means for discharging air toward the printed sheet material after the sheet material moves away from the stripper means.

12. The apparatus of claim 11 wherein:

the air dispenser means includes a manifold, means for mounting the manifold on the frame, a plurality of nozzles mounted on the manifold, each of said nozzles having a passage for directing streams of air toward the printed sheet material, and valve means mounted on the manifold for regulating the amount of air flow through the passages of the nozzles.

13. The apparatus of claim 12 including:

means for carrying air under pressure from the manifold to the means for directing a stream of air toward the roller having the blanket.

14. The apparatus of claim 12 including:

regulating means connected to the manifold to regulate the pressure of the air flow to the manifold.

15. The apparatus of claim 1 including:

an ink demulsifier mountable of the frame for discharging air to an ink carrying roller to set up and dry water in the ink on the ink carrying roller.

16. The apparatus of claim 15 wherein:

the ink demulsifier includes a member having a passage and orifices open to the passage facing the roller for directing air toward said roller thereby setting up and drying water in the ink on the roller.

17. The apparatus of claim 16 including:

regulator means connected to the member to regulate the pressure of the air flowing to the passage in the member thereby regulating the rate of flow of air through said orifices.

18. The apparatus of claim 1 including:

air dispenser means for discharging air toward the printed sheet material after the sheet material moves away from the stripper means, and an ink demulsifier mountable on the frame for discharging air to an ink carrying roller to set up and dry water in the ink on said ink carrying roller.

19. The apparatus of claim 18 including:

first regulator means to regulate the pressure of the air flowing to the air dispenser means, and second regulator means to regulate the pressure of the air flowing to the ink demulsifier.

20. A method of assisting in separating printed sheet material from a blanket on a rotating roller of a printing press comprising:

directing printed sheet material away from the blanket on the rotating roller with a body having a nose projected toward the roller having the blanket, and directing a stream of air from means mounted on the body for dispensing air toward the roller to assist in separating printed sheet material from the blanket on the rotating roller.

21. The method of claim 20 including:

directing a second stream of air toward the printed sheet material after the sheet material has been separated from the blanket on the rotating roller.

22. The method of claim 21 including:

regulating the pressure of the air directed toward the roller, and regulating the pressure of the second stream of air directed toward the printed sheet material.

23. The method of claim 20 including:

directing a plurality of streams of air toward the roller to assist in separating printed sheet material from the blanket on the rotating roller.

24. The method of claim 23 including:

directing second streams of air toward the printed sheet material after the sheet material has been separated from the blanket on the rotating roller.

25. The method of claim 24 including:

regulating the pressure of the streams of air directed toward the roller, and regulating the pressure of the second streams of air directed toward the printed sheet material.

* * * * *